US008388469B1

(12) United States Patent
Hawthorn et al.

(10) Patent No.: US 8,388,469 B1
(45) Date of Patent: Mar. 5, 2013

(54) INLAY GOLF BALL MARKER

(75) Inventors: Robin K. Hawthorn, Charlotte, NC (US); L. Terry I. Soffer, Charlotte, NC (US)

(73) Assignee: Mark it Art, Inc., Charlotte, NC (US)

( * ) Notice: Subject to any disclaimer, the term of this patent is extended or adjusted under 35 U.S.C. 154(b) by 322 days.

(21) Appl. No.: 12/927,568

(22) Filed: Nov. 18, 2010

Related U.S. Application Data

(60) Provisional application No. 61/281,493, filed on Nov. 18, 2009.

(51) Int. Cl.
*A63B 57/00* (2006.01)

(52) U.S. Cl. ..... 473/406

(58) Field of Classification Search ..... 473/406, 473/285; D21/793, 794
See application file for complete search history.

(56) References Cited

U.S. PATENT DOCUMENTS 3,407,523 A * 10/1968 Winston ..... 40/1.5
3,439,439 A * 4/1969 Stimson ..... 40/1.5
3,715,781 A * 2/1973 Salvatori ..... 24/114.9
4,531,310 A * 7/1985 Acson et al. ..... 40/1.5
4,767,647 A * 8/1988 Bree ..... 428/14
5,283,966 A * 2/1994 Rader et al. ..... 40/1.5
5,569,103 A * 10/1996 Sihn ..... 473/406
5,795,249 A * 8/1998 Johnson ..... 473/406
6,017,282 A * 1/2000 Stefonsky ..... 473/406
6,077,174 A * 6/2000 Noritake ..... 473/406
6,422,955 B1 * 7/2002 Lopez ..... 473/406
6,450,903 B1 * 9/2002 Tate ..... 473/406
6,588,067 B2 * 7/2003 Efron et al. ..... 24/102 SL
D540,902 S * 4/2007 Regalado ..... D21/794
7,856,697 B2 * 12/2010 Quimod ..... 24/113 R
2009/0274909 A1 * 11/2009 Bergevin et al. ..... 428/406
2009/0305818 A1 * 12/2009 Cameron ..... 473/406
2010/0151972 A1 * 6/2010 Lim ..... 473/406

* cited by examiner

*Primary Examiner* — Steven Wong
(74) *Attorney, Agent, or Firm* — Schwartz Law Firm, P.C.

(57) ABSTRACT

A golf ball marker includes a base and an ornamental inlay. The base defines a closed recess, and has a flat marginal surface surrounding the recess. The ornamental inlay is carried by the base, and held flush within the recess such that an outside surface of the inlay and the flat marginal surface of the base reside in substantially the same plane and form a substantially continuous smooth top surface of the ball marker.

16 Claims, 4 Drawing Sheets

INLAY GOLF BALL MARKER

TECHNICAL FIELD AND BACKGROUND OF THE INVENTION

This invention relates broadly and generally to the golf industry, and more particularly to a device for marking a golf ball on the green of a golf course. Marking a golf ball on the green allows the player to put the ball back in the exact spot after it has been picked up for any reason.

When multiple players hit to the green on a hole, the golfers closest to the pin may have to mark the spot where their balls lie. If not, their golf balls may be in a direct line with a player's ball that is farther away and might be hit when that player putts his or her ball; or, the balls closer to the cup may impede other golfers' ability to read their putts. By marking a ball in line with another person's chip or putt, the potential for the ball hindering that person's shot is significantly reduced.

Objects such as small coins or specially designed ball markers are traditionally used to mark the spot where a golf ball previously was on the green. Under the rules of golf, a ball marker is termed a "movable obstruction" and any deflection of the putted golf ball precipitated by the ball marker must be played where the ball winds up.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a golf ball marker including a base and an ornamental inlay. The base defines a closed recess, and comprises a flat marginal surface surrounding the recess. The ornamental inlay is carried by the base, and held flush within the recess such that an outside surface of the inlay and the flat marginal surface of the base reside in substantially the same plane and form a substantially continuous smooth top surface of the ball marker.

According to another exemplary embodiment, the base further defines a sunken centerpoint within the recess and adapted for receiving a liquid bonding agent.

According to another exemplary embodiment, a vertical post is formed with an underside of the base.

According to another exemplary embodiment, the vertical post defines an internal cavity, and comprises an elongated magnet located within the cavity.

According to another exemplary embodiment, the ornamental inlay comprises a homogeneous non-metallic material.

According to another exemplary embodiment, the ornamental inlay comprises a gemstone.

According to another exemplary embodiment, the ornamental inlay comprises a decorative shell.

According to another exemplary embodiment, the ornamental inlay comprises a corporate emblem.

According to another exemplary embodiment, the ornamental inlay comprises a protective resin coating.

According to another exemplary embodiment, the base comprises a metal selected from a group consisting of brass, copper, steel, aluminum, platinum, silver, and gold.

According to another exemplary embodiment, the flat marginal surface of the base is substantially annular.

In yet another exemplary embodiment, the present disclosure comprising a golf ball marker including a metallic base and a non-metallic ornamental inlay. The base defines a closed recess, and comprises a flat marginal surface surrounding the recess and producing a relatively specular light reflection. The ornamental inlay is carried by the base and produces a relatively nonspecular light reflection. The ornamental inlay is held flush within the recess such that an outside surface of the inlay and the flat marginal surface of the base reside in substantially the same plane and form a substantially continuous smooth top surface of the ball marker.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
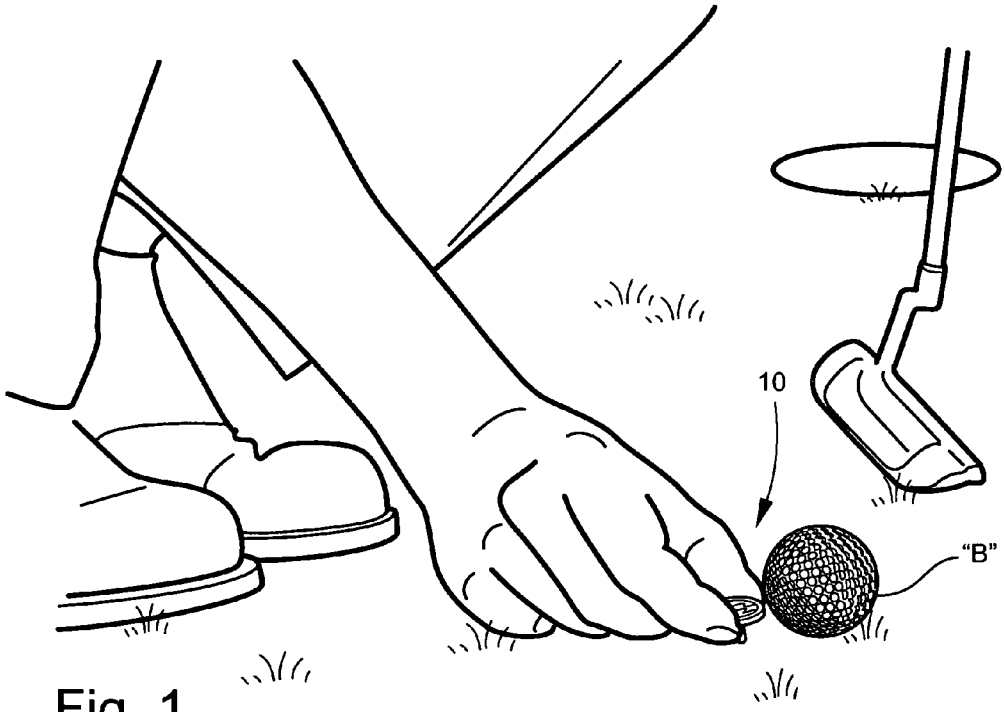
FIG. 1 is an environmental view of an exemplary inlay golf ball marker according to one embodiment of the present disclosure.
Figure 2:
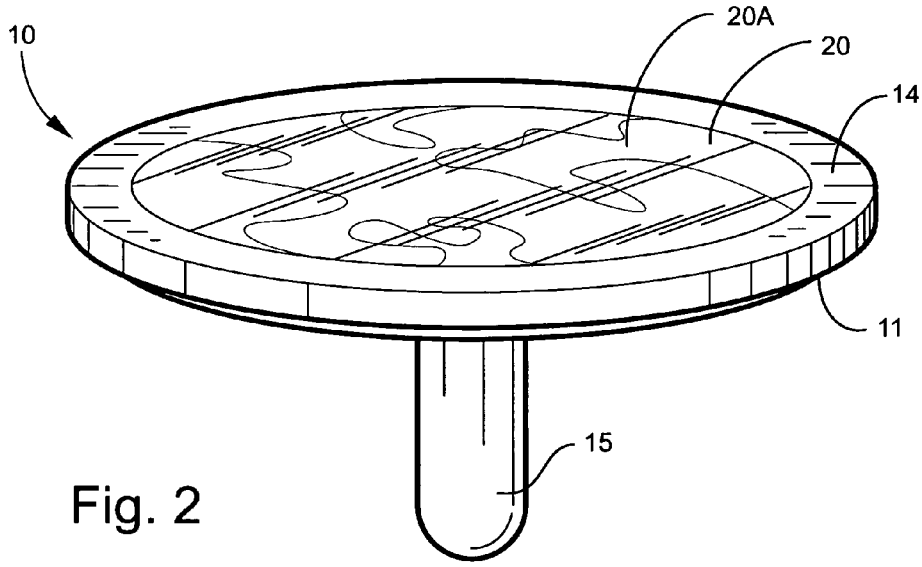
FIG. 2 is a perspective view of the golf ball marker.

Referring now specifically to the drawings, an inlay golf ball marker according to one exemplary embodiment of the present invention is illustrated in FIGS. 1 and 2, and shown generally at reference numeral 10. The exemplary golf ball marker 10 comprises a generally small object designed to mark the position of a golf ball "B" when the ball is lifted on the putting green. According to the rules of golf, the ball marker 10 is placed directly behind the golf ball "B" before the ball is lifted. The ball "B" is then replaced directly in front of the ball marker 10, on its original spot.

Figure 3:
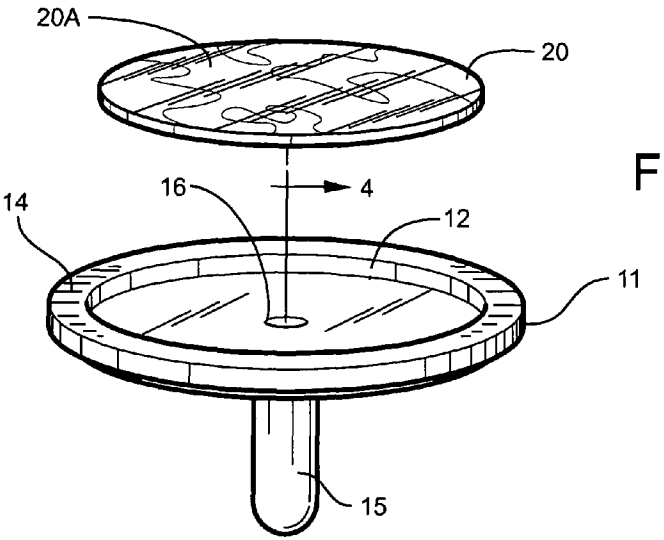
FIG. 3 is an exploded view of the golf ball marker.
Figure 4:
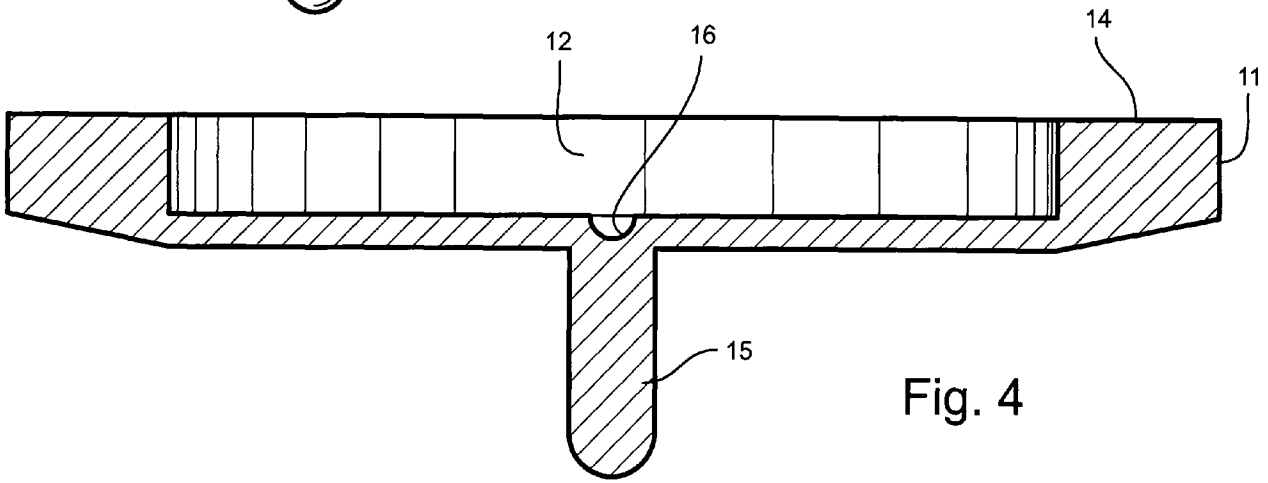
FIG. 4 is a cross-sectional view of the golf ball marker taken substantially along line 4 of FIG. 3.

As best shown in FIGS. 2, 3, and 4, the exemplary golf ball marker 10 comprises a solid rigid base 11 defining a closed sunken recess 12, and having a flat marginal annular surface 14 surrounding the recess 12. An elongated ground-penetrating post 15 may depend from an underside of the base 11, and may be integrally formed with the base 11 of any suitable (e.g., homogeneous) material including, for example, brass, copper, aluminum, gold, silver, platinum, and the like. The recess 12 of the base 11 may be formed by drilling (at center drill point 16), and may be substantially annular. In other exemplary embodiments, the base 11 may be cast, forged, or molded to form the recess 12 in any desired depth and shape, such as square, triangular, octagonal, or the like.

A thin decorative inlay 20 resides closely within the annular recess 12 of the base 11, and may be permanently attached to the base 11 using a resin adhesive or other suitable bonding agent. The adhesive may reside partially or substantially within the drill point 16 prior to insertion of the inlay 20. In one exemplary embodiment, the inlay 20 has a clear inlace resin coating 21 (FIG. 6) which permanently mounts the inlay, adds a glossy surface, and protects the inlay against scratches and other surface damage. The resin coating 21 may comprise an unsaturated polyester resin in styrene. In other embodiments, the decorative inlay 20 may be removable and exchangeable. The top surface 20A of the inlay 20 is preferably substantially flush with the flat marginal surface 14 of the base 11, such that both surfaces reside in substantially the same plane and form a substantially continuous (e.g., essentially seamless) smooth top surface of the ball marker 10. The inlay 20 may be formed of any suitable material including decorative shells, flat gemstones, resin, plastic, and the like.

Figure 5:
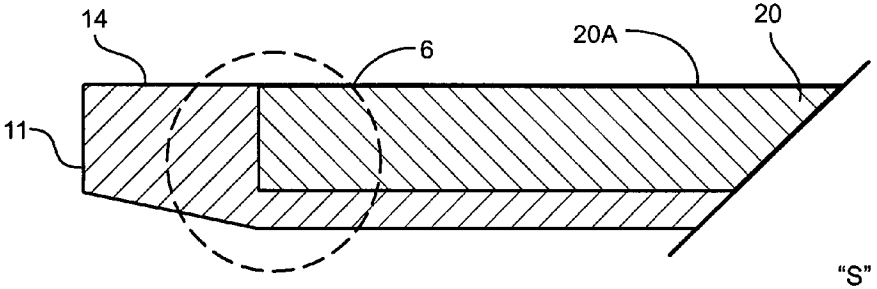
FIG. 5 is a fragmentary cross-sectional view of the golf ball marker.
Figure 6:
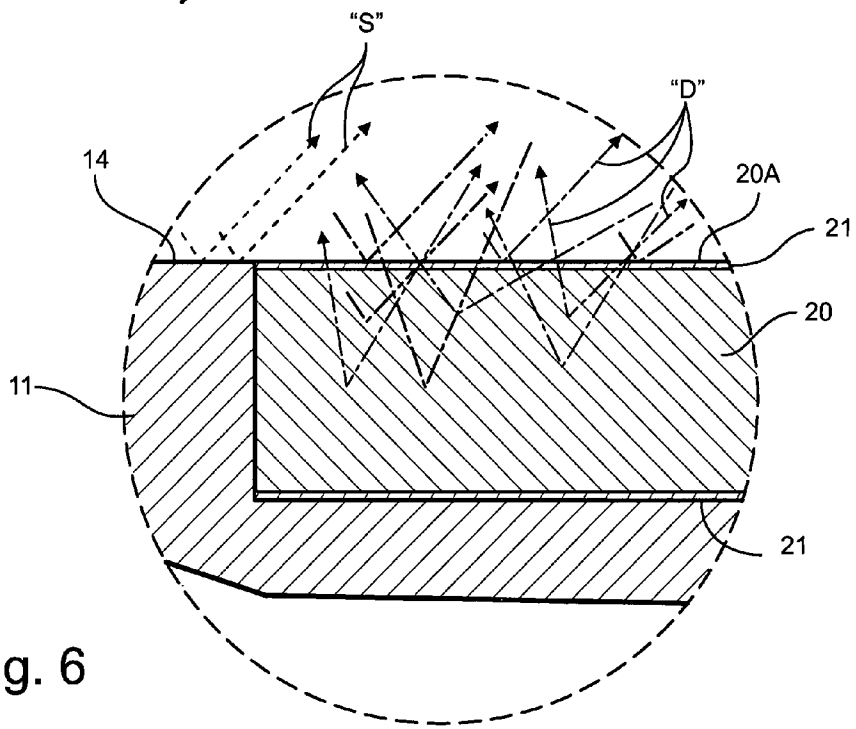
FIG. 6 is an enlarged view of the golf ball marker substantially within the designated area indicated at 6 in FIG. 5.

Referring to FIGS. 5 and 6, the exemplary ball marker 10 comprises a brass base 11 producing a relatively specular light reflection, as indicated at "S", and a resin-coated gemstone inlay 20 producing a relatively nonspecular (or diffuse) light reflection, a indicated at "D". The resin coating 21 may be applied such that it entirely covers at least the top and bottom surfaces of the gemstone inlay 20.

In the exemplary embodiment, the outside diameter of the base 11 is approximately 0.750 inches (19 mm), the diameter of the inlay 20 approximately 0.470 inches (12 mm), and the diameter of the recess 12 approximately 0.483 inches (12.27 mm). The thickness of the inlay 20 may be less than 0.060 inches (1.52 mm). The depth of the recess 12 may be approximately 0.064 inches (1.63 mm). The flat marginal surface 14 of the base 11 may comprise at least 25% of the total area defined by the continuous top surface of the ball marker 10, and less than 50% of the total area defined by the continuous top surface of the ball marker 10.

Figure 7:
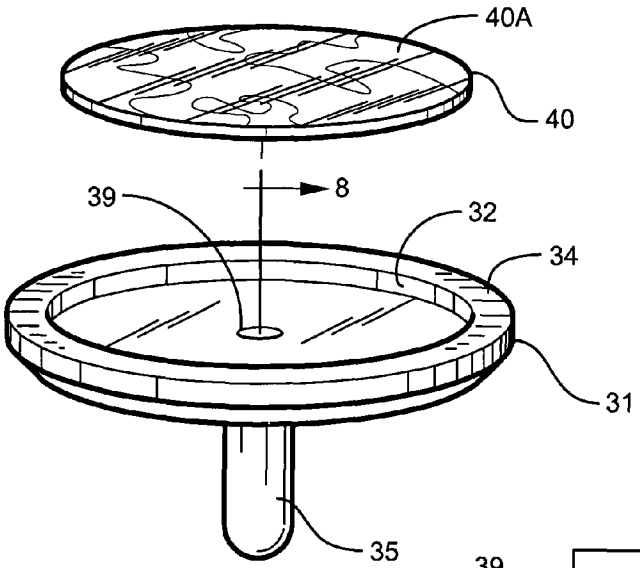
FIG. 7 is an exploded view of the golf ball marker according to an alternative exemplary embodiment.
Figure 8:
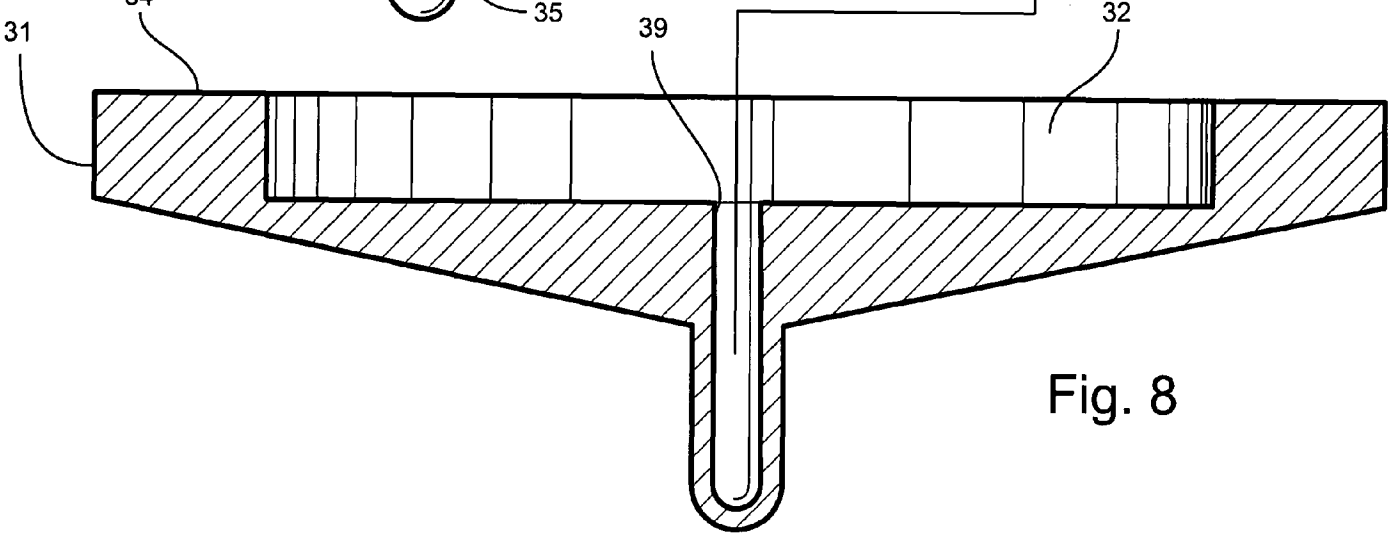
FIG. 8 is a cross-sectional view of the golf ball marker taken substantially along line 8 of FIG. 7, and showing the cylindrical magnet removed from the marker post.

An alternative embodiment of the exemplary golf ball marker 30 is shown in FIGS. 7 and 8. The exemplary golf ball marker 30 comprises a rigid base 31 defining a closed sunken recess 32, and having a flat marginal annular surface 34 surrounding the recess 32. An elongated ground-penetrating post 35 depends from an underside of the base 31, and may be integrally formed (e.g., machined or welded) with the base 31 of a suitable metal. In this embodiment, the post 35 is substantially hollow and is designed to receive and store a cylindrical magnet 38 through opening 39. Like marker 10, a thin decorative inlay 40 resides closely within the annular recess 32 of the base 31, and may be formed of any suitable material including decorative shells, flat gemstones, resin, plastic, and the like. The top surface 40A of the inlay 40 is preferably substantially flush with the flat marginal surface 34 of the base 31, such that both surfaces reside in substantially the same plane and form a substantially continuous and essentially seamless smooth top surface of the ball marker 30. Alternatively, or in addition to magnet 38, the exemplary golf ball marker 30 may have a ferromagnetic coating applied to the underside of base 31 sufficient to attract and hold the marker 30 to metal surfaces. In further alternative embodiments, the golf ball marker may comprise only the recessed base and inlay (with no ground-penetrating post).

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A golf ball marker, comprising:

a base defining a closed recess, and comprising a flat marginal surface surrounding said recess;

a vertical post formed with an underside of said base and defining an internal cavity, and said vertical post comprising an elongated magnet located within said cavity; and an ornamental inlay carried by said base, and held flush within said recess such that an outside surface of said inlay and the flat marginal surface of said base reside in substantially the same plane and form a substantially continuous smooth top surface of said ball marker.

2. A golf ball marker according to claim 1, wherein said base further comprises a sunken centerpoint within said recess and adapted for receiving a liquid bonding agent.

3. A golf ball marker according to claim 1, wherein said ornamental inlay comprises a homogeneous non-metallic material.

4. A golf ball marker according to claim 1, wherein said ornamental inlay comprises a gemstone.

5. A golf ball marker according to claim 1, wherein said ornamental inlay comprises a decorative shell.

6. A golf ball marker according to claim 1, wherein said ornamental inlay comprises a corporate emblem.

7. A golf ball marker according to claim 1, wherein said ornamental inlay comprises a protective resin coating.

8. A golf ball marker according to claim 1, wherein said base comprises a metal selected from a group consisting of brass, copper, steel, aluminum, platinum, silver, and gold.

9. A golf ball marker according to claim 1, wherein the flat marginal surface of said base is substantially annular.

10. A golf ball marker, comprising:

a metallic base defining a closed recess, and comprising a flat marginal surface surrounding said recess and producing a relatively specular light reflection;

a vertical post formed with an underside of said base and defining an internal cavity, and said vertical post comprising an elongated magnet located within said cavity; and a nonmetallic ornamental inlay carried by said base and producing a relatively nonspecular light reflection, said ornamental inlay held flush within said recess such that an outside surface of said inlay and the flat marginal surface of said base reside in substantially the same plane and form a substantially continuous smooth top surface of said ball marker.

11. A golf ball marker according to claim 10, wherein said base further comprises a sunken centerpoint within said recess and adapted for receiving a liquid bonding agent.

12. A golf ball marker according to claim 10, wherein said ornamental inlay comprises a homogeneous non-metallic material.

13. A golf ball marker according to claim 10, wherein said ornamental inlay comprises a gemstone.

14. A golf ball marker according to claim 10, wherein said ornamental inlay comprises a decorative shell.

15. A golf ball marker according to claim 10, wherein said ornamental inlay comprises a corporate emblem.

16. A golf ball marker according to claim 10, wherein said ornamental inlay comprises a protective resin coating.

* * * * *